US005875501A

United States Patent [19]

Jury

[11] Patent Number: 5,875,501

[45] Date of Patent: Mar. 2, 1999

[54] PATIENT LIFT

[76] Inventor: Dan E. Jury, 313 N. Colorado, Ulysses, Kans. 67880

[21] Appl. No.: 895,289

[22] Filed: Jul. 16, 1997

[51] Int. Cl.[6] ..... A61G 7/10

[52] U.S. Cl. ..... 5/81.1 R; 5/83.1

[58] Field of Search ..... 5/601, 81.1 R, 5/137, 146, 147, 159.1, 83.1

[56] References Cited

U.S. PATENT DOCUMENTS

| | | | |
|---|---|---|---|
| 3,517,397 | 6/1970 | Moore | 5/147 |
| 3,703,735 | 11/1972 | Moore | 5/147 |
| 3,882,555 | 5/1975 | Edlund . | |
| 4,144,713 | 3/1979 | Clark et al. . | |
| 4,202,063 | 5/1980 | Murray . | |
| 4,534,076 | 8/1985 | Barge | 5/147 |
| 4,631,763 | 12/1986 | Singer | 5/159.1 X |
| 4,649,581 | 3/1987 | Lee, Jr. . | |
| 5,230,112 | 7/1993 | Harrawood et al. . | |
| 5,265,689 | 11/1993 | Kauffmann . | |
| 5,379,468 | 1/1995 | Cassidy et al. . | |
| 5,524,303 | 6/1996 | Palmer, Jr. et al. . | |

*Primary Examiner*—Michael F. Trettel
*Attorney, Agent, or Firm*—Chase & Yakimo, L.C.

[57] ABSTRACT

A patient lift includes a frame attached to a vertical surface. The frame includes first and second vertical guide posts with a parallel screw shaft rotatably mounted therebetween. A hub engages the screw shaft and travels up and down the screw shaft according to a direction of rotation of the screw shaft as provided by a drive train coupled to the drive shaft. Upon connection of the head end of the bed frame to the hub, the head end travels with the hub so as to move the bed between horizontal and vertical positions relative to the underlying support surface. A roller member at the foot end of enhances the movement of the bed frame between the ground adjacent horizontal and vertical positions. A foot rest at the foot of the bed precludes the patient from sliding forward during bed movement. An alternative embodiment connects a chair so as to raise or lower the seated patient relative to the underlying support surface.

19 Claims, 11 Drawing Sheets

PATIENT LIFT

BACKGROUND OF THE INVENTION

This invention relates to a lifting device for an incapacitated person and, more particularly, a device for moving a patient between ground adjacent and sitting or standing positions.

Various devices have been proposed in the prior art which move patients between various positions and/or transfer the patient from one location to another.

Although assumably effective in operation, such known devices are relatively complex in construction and/or not adaptable for home use. Thus, it is desirable to have a device which enables one to be moved from a ground adjacent to a sitting or standing position either with or without the assistance of another.

SUMMARY OF THE INVENTION

In response thereto I have invented a patient lift which utilizes a support frame attached to a wall, the frame including a vertically extending, rotatable screw shaft. Engaging the screw shaft is a hub such that a selectable rotation of the shaft causes the hub to travel either up or down the shaft depending on the direction of shaft rotation. Attached to the hub are support arms adapted to engage the framework of a bed or the like, the bed having a roller at the foot end thereof. A user-controlled motor coupled to the shaft rotates the shaft in either clockwise or counterclockwise directions. Upon such rotation the hub, as geared to the shaft, moves up or down the shaft so as to concurrently move the hub and attached bed between vertical and horizontal relationships relative to the floor.

Alternatively, a chair is connected to the support arms of the hub so as to move a seated patient either closer to or away from the floor. This movement enhances a transfer of the patient from the chair to a standing position or wheelchair, etc.

It is therefore a general object of this invention to provide a patient lift for moving a patient between horizontal and vertical positions.

Another object of this invention is to provide a patient lift, as aforesaid, which can raise or lower the patient relative to an underlying floor.

A further object of this invention is to provide a patient lift, as aforesaid, having a particularly designed bed attached thereto which is movable between horizontal and vertical positions.

Still another object of this invention is to provide a patient lift, as aforesaid, which is adaptable for connection to other patient support devices such as a chair or the like.

A particular object of this invention is to provide a patient lift, which is easy to use, either by the patient or an assistant.

Another particular object of this invention is to provide a patient lift, as aforesaid, which is adaptable for use in a home or the like.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
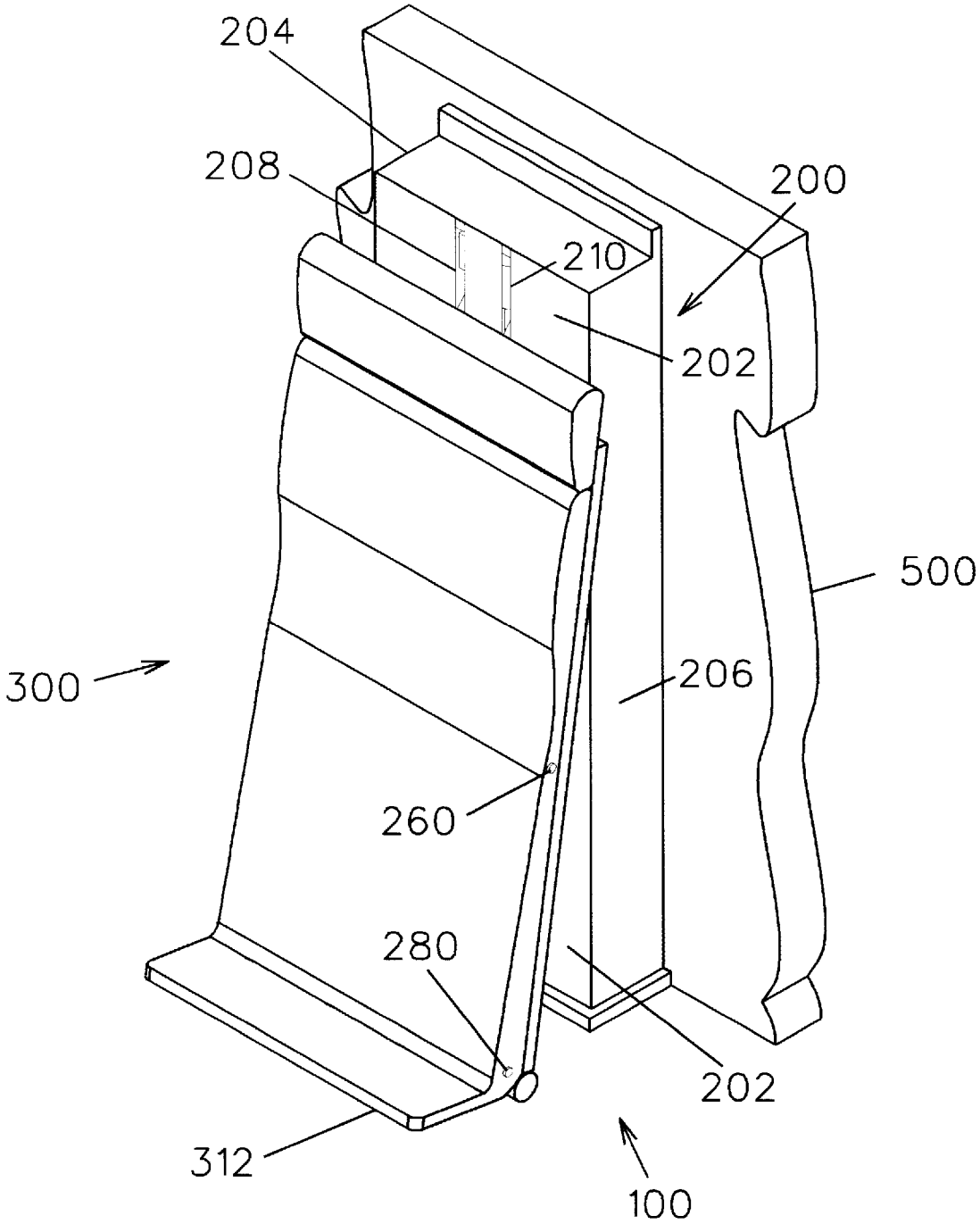
FIG. 1 is a perspective view of the patient lift with a bed attached thereto, the bed approaching a vertical position relative to the floor.
Figure 2:
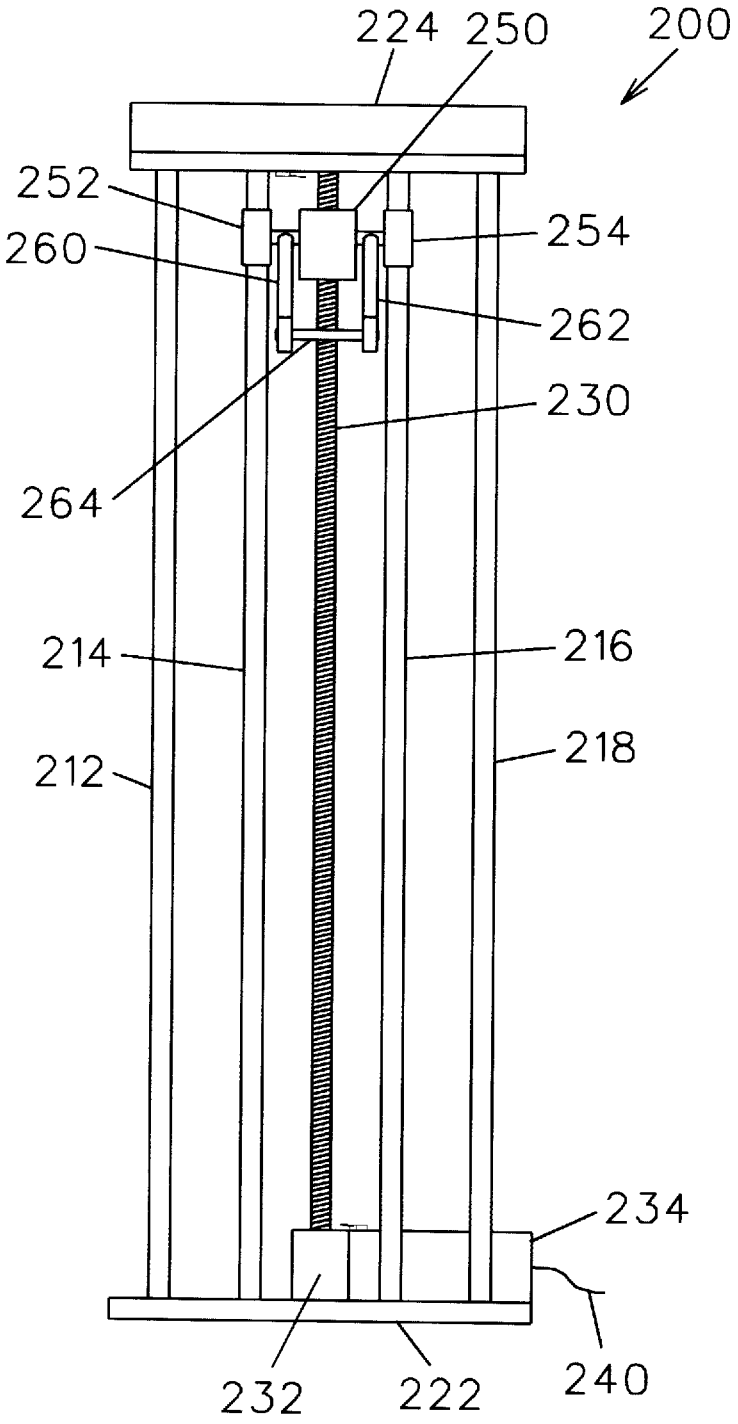
FIG. 2 is a front view of the lift housing with the outer wall removed so as to show the internal parts.
Figure 3:
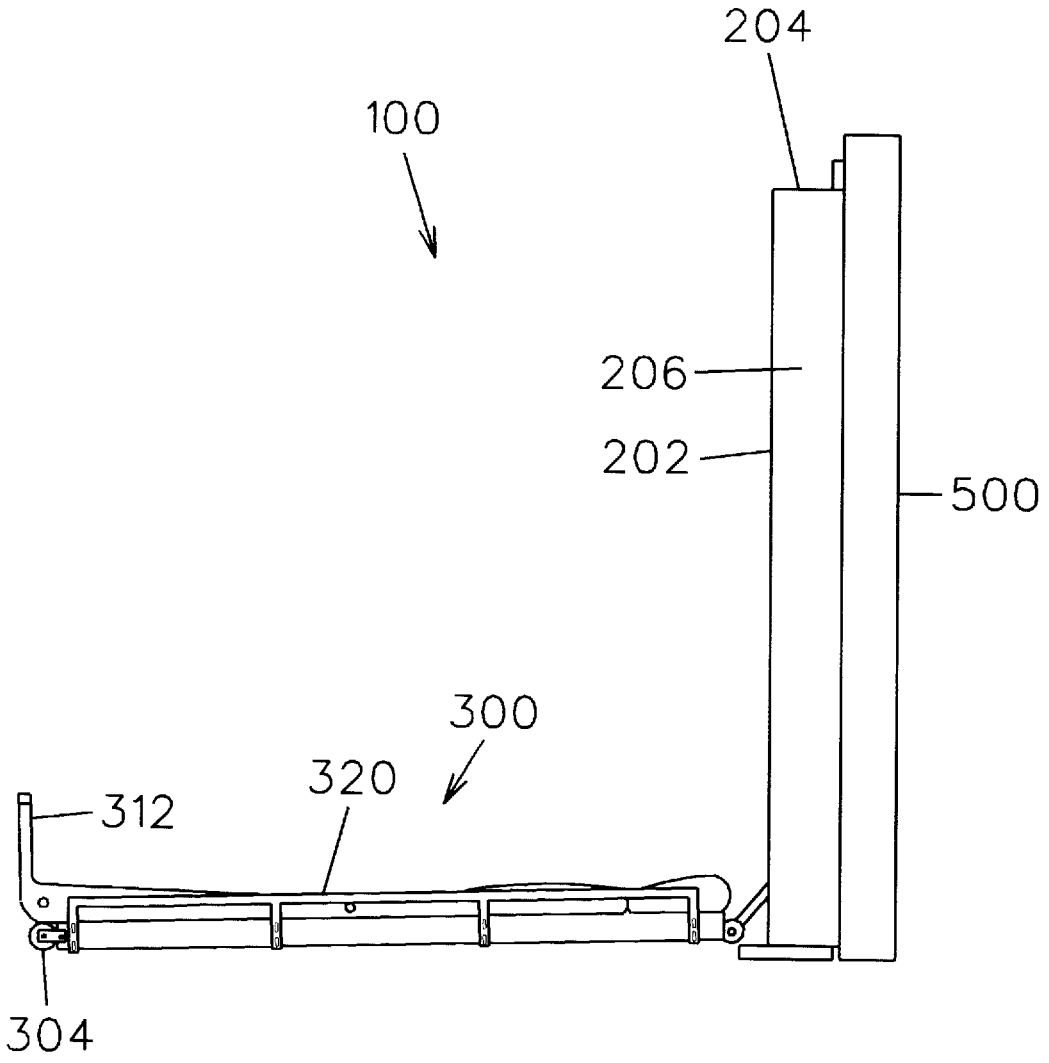
FIG. 3 is a side view of the apparatus of FIG. 1 with the bed in a horizontal position.
Figure 4:
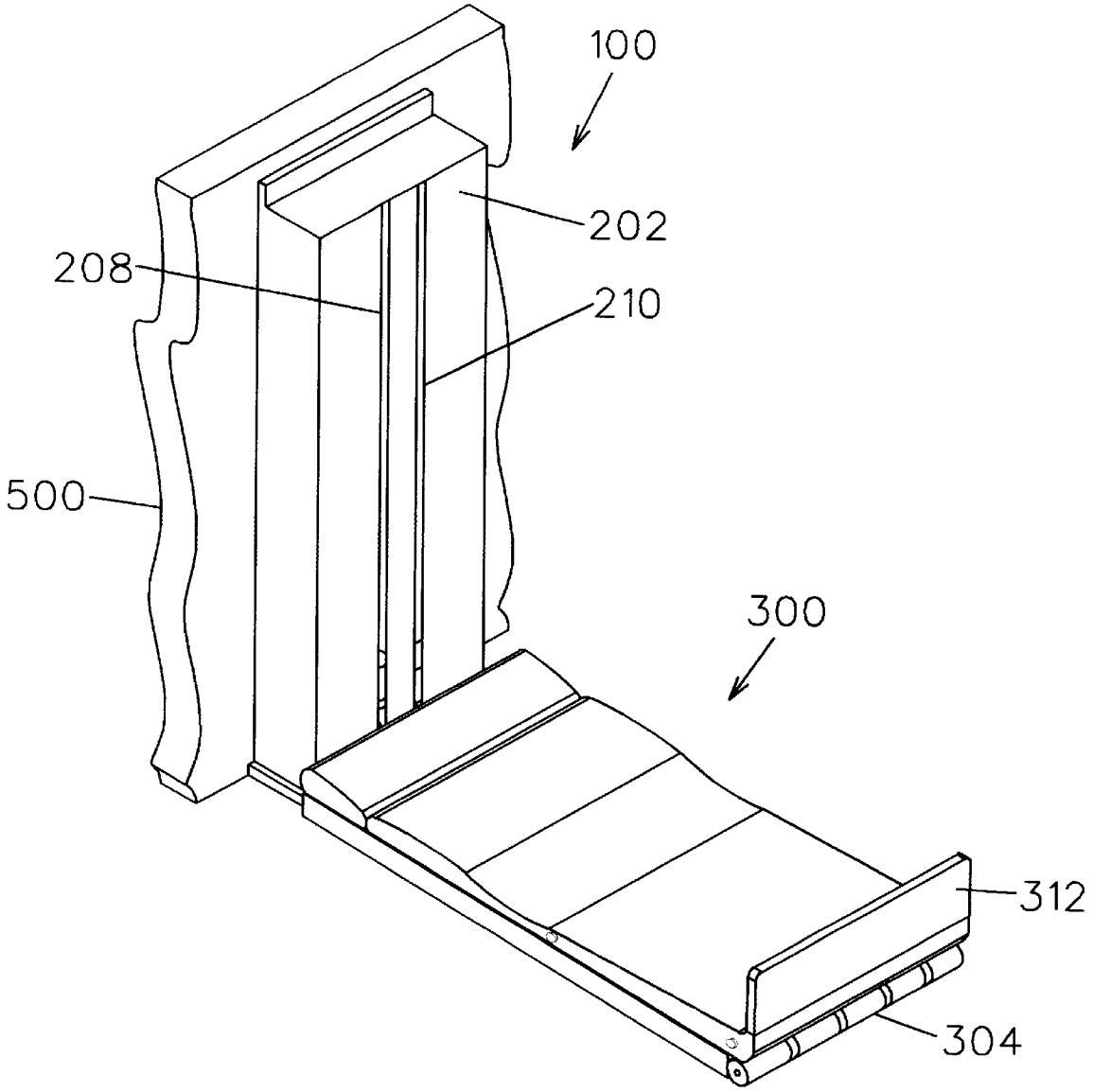
FIG. 4 is a perspective view of the lift of FIG. 3 with the bed in a horizontal position.
Figure 5:
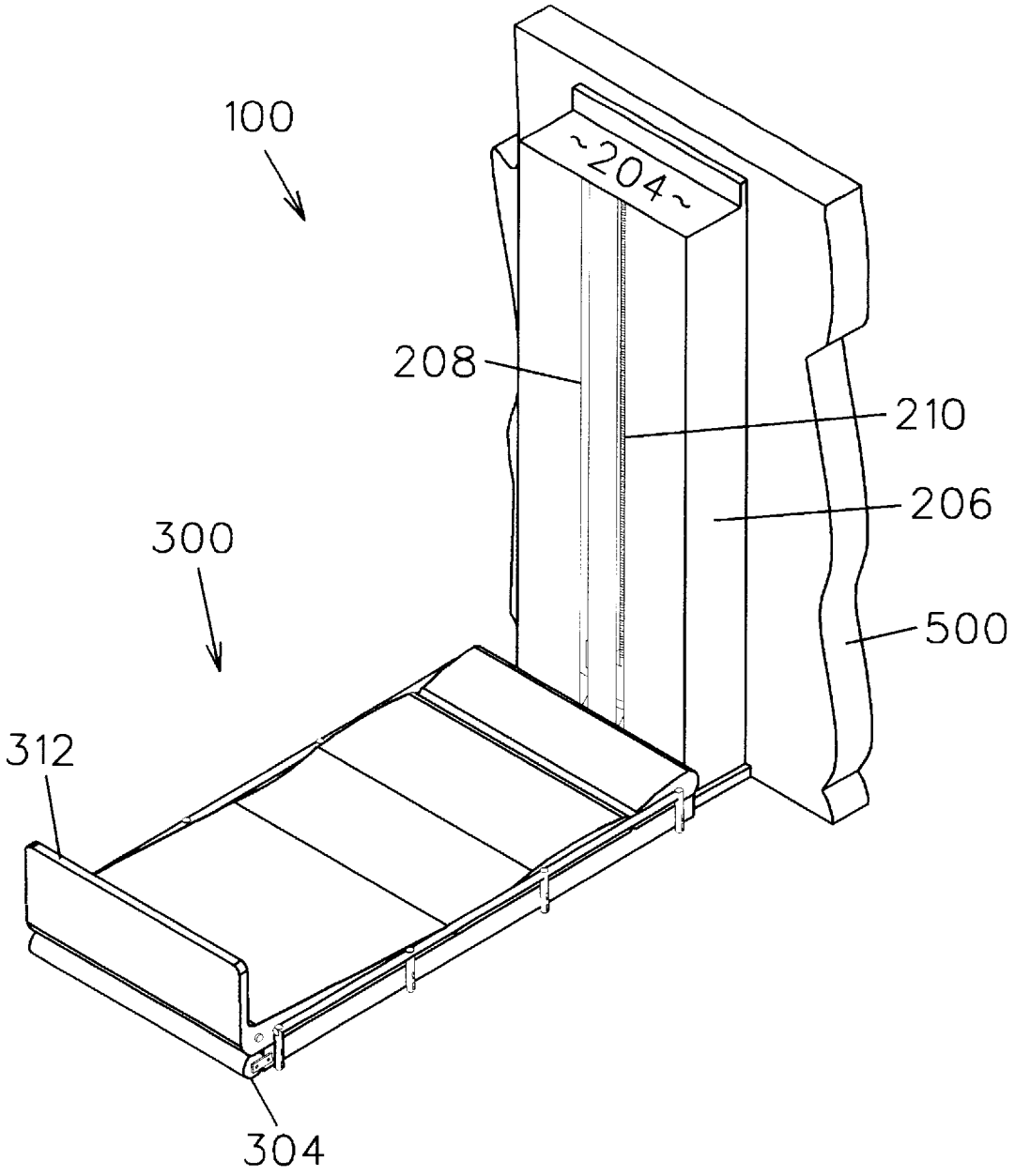
FIG. 5 is a perspective view of the bed of FIG. 4 with the bed in a horizontal position, the bed having side rails attached thereto.
Figure 6:
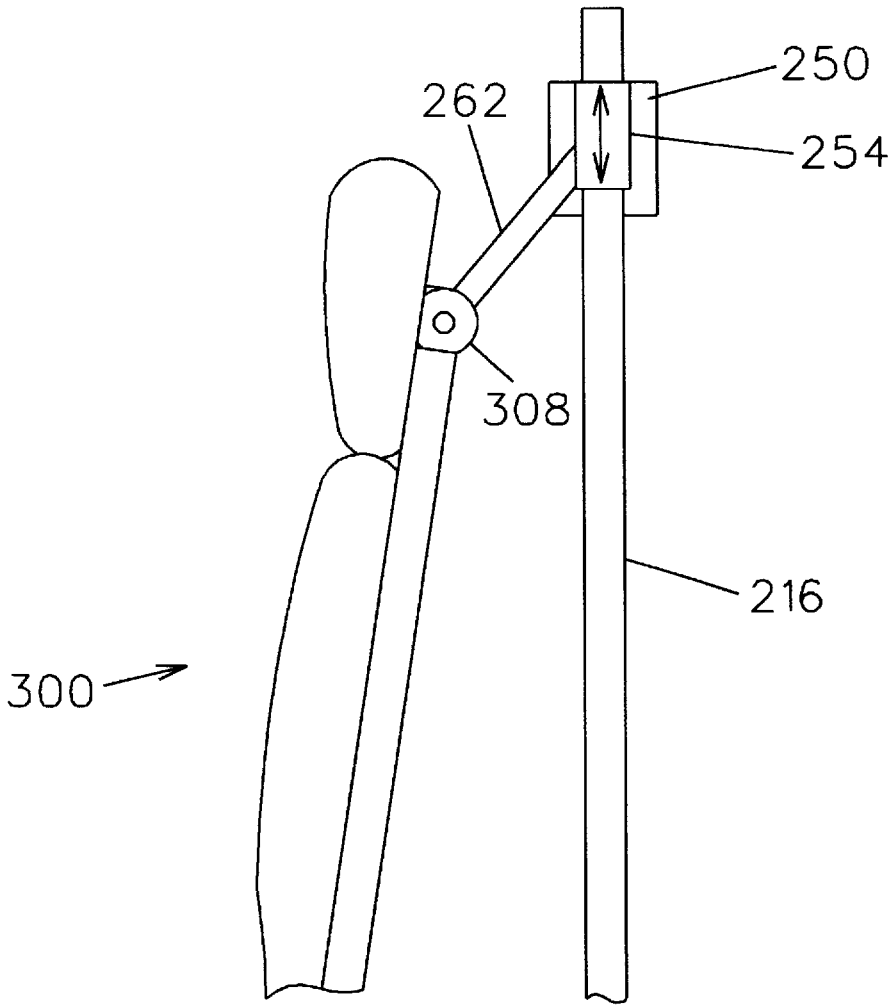
FIG. 6 is a fragmentary side view of the patient lift showing the attachment of the bed to the lift proper, the outside frame portion being removed.

Turning more particularly to the drawings, FIG. 1 shows a first embodiment of the patient lift 100 as attached to a vertical support surface such as the wall 500 of a house or the like. The lift 100 includes a lift housing 200 with a bed 300 attached thereto.

The lift housing 200 includes a front wall 202 and side walls 204, 206 with laterally spaced apart slots 208, 210 along the vertical extent of the front wall 202. Located within the housing 200 is a framework including first and second outside vertical struts 212, 218 with a pair of interior guide posts 214, 216 therebetween. Laterally spanning the opposed bottom and top ends of the framework is a reinforcing base 222 and top strut 224.

Extending between the base 222 and top strut 224 is a vertical screw shaft 230, the shaft 230 positioned between laterally spaced apart guide posts 214, 216. The bottom of screw shaft 230 is coupled to a transmission/gear assembly 232 which in turn is coupled to a motor 234, the motor 234 being connected to house power 236 by wire 240. Energization of the motor is controlled by buttons 260, 280 wired thereto so that the motor shaft 235 can be rotated in first and second opposed rotations. Buttons 260, 280 are not restricted to the positions shown. Upon such rotation the coupled screw shaft 230 rotates in either clockwise or counterclockwise directions about its central vertical axis.

Hub 250 is attached about shaft 230, the hub having an internal gear such as a rack gear so that shaft 230 rotation causes hub 250 to travel up or down the shaft 230 according to the direction of screw 230 rotation.

Laterally extending from hub 250 and about the guide posts 214, 216 are sleeve bearing blocks 252, 254. Accordingly, during hub 250 movement, these blocks 252, 254 concurrently slide along the respective guide posts 214, 216 so as to maintain the hub 250 in a desired relationship with the shaft 230.

Forwardly extending from hub 250 are two support arms 260, 262 having a journaled shaft 264 extending between the ends of the support arms 260, 262. The journal ends of the shaft 264 are rotatable within bearings found at the end of each respective support arm. Shaft 264 may be fixed if so desired.

A bed 300 includes a frame 302 with a roller member 304 being mounted at the front end thereof. Along the head end 306 of frame 300 are flanges 308 for engaging the shaft 264. Bed 306 further includes a foot rest 312 for supporting a patient. Side rails 320 preclude a prone patient from rolling off the bed.

In use a patient in the bed 300 may be raised from a horizontal to a vertical position upon depression of button 360. Depression of button 360 closes a simple electrical circuit with the motor 234 therein and causes rotation of the screw shaft 230 in a first direction. Concurrently, hub 250 travels up the shaft 230 as well as the head end 306 of the bed attached thereto. This upward hub 250 movement urges the bed from a ground adjacent position to a vertical position as assisted by the roller member 304. Raising the bed to a vertical position allows the user to more easily exit the bed for subsequent ambulatory movement with or without the assistance of another. Foot rest 312 provides underlying support to the user. Upon a desired movement to a horizontal position, the patient steps onto the foot rest 312. Depression of button 380 energizes the motor 234 and rotates shaft 230 in an opposed direction. The action causes the hub 350 to travel down the shaft 230 and the bed 300 attached thereto from the vertical position toward the ground-adjacent position as again assisted by the roller member 304. Foot rest 312 supports the patient thereon during such movement as well as precludes the patient from sliding out the foot end of the bed.

Limit switches 370, 380 at the top and bottom of the shaft 230 and wired into the circuit disconnects power to the motor 234 so as to preclude shaft 230 rotation and further hub 250 movement when the hub 250 approaches the top strut 224 or base 222 adjacent the opposed ends of the shaft 230.

Accordingly, it can be seen that the patient lift 100 can move the patient between horizontal and vertical positions. This lift can also be used if the patient has fallen and needs assistance in being raised from the fallen position.

Figure 7:
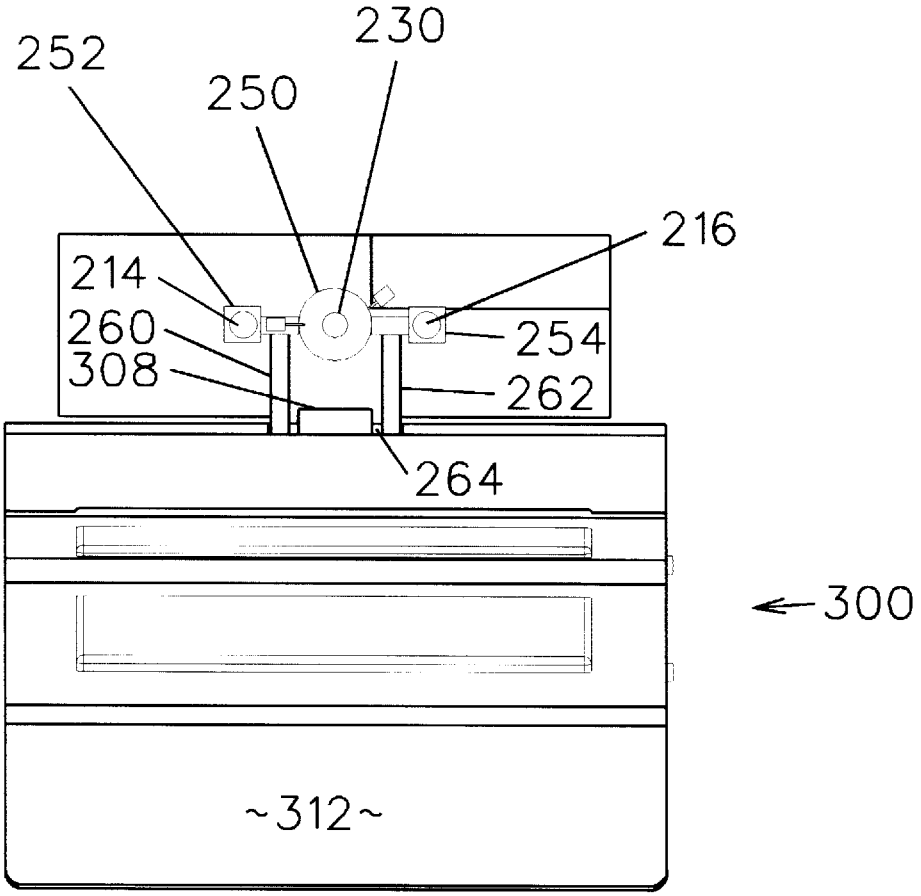
FIG. 7 is a top view of the lift with the bed in a vertical position, a portion of the housing broken away to show the lift therein.
Figure 8:
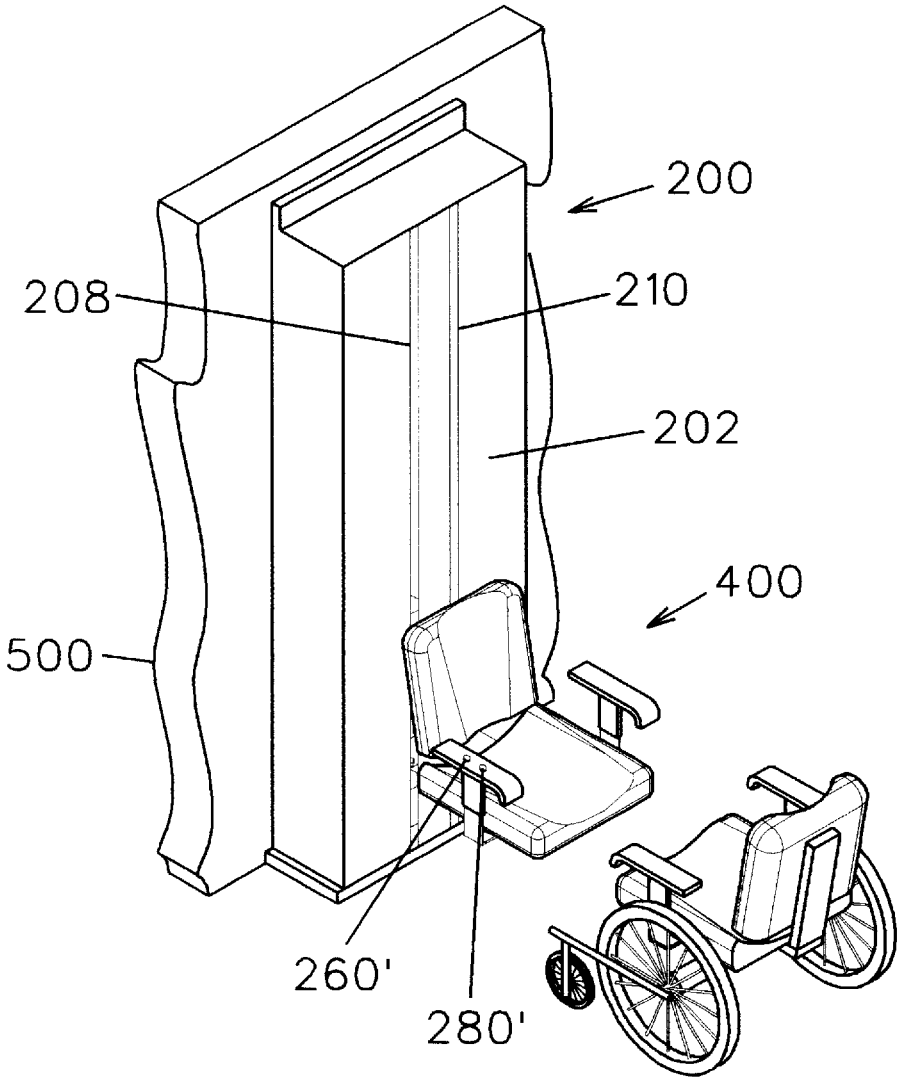
FIG. 8 is an alternative embodiment of the invention showing a chair attached to the lift housing.
Figure 9:
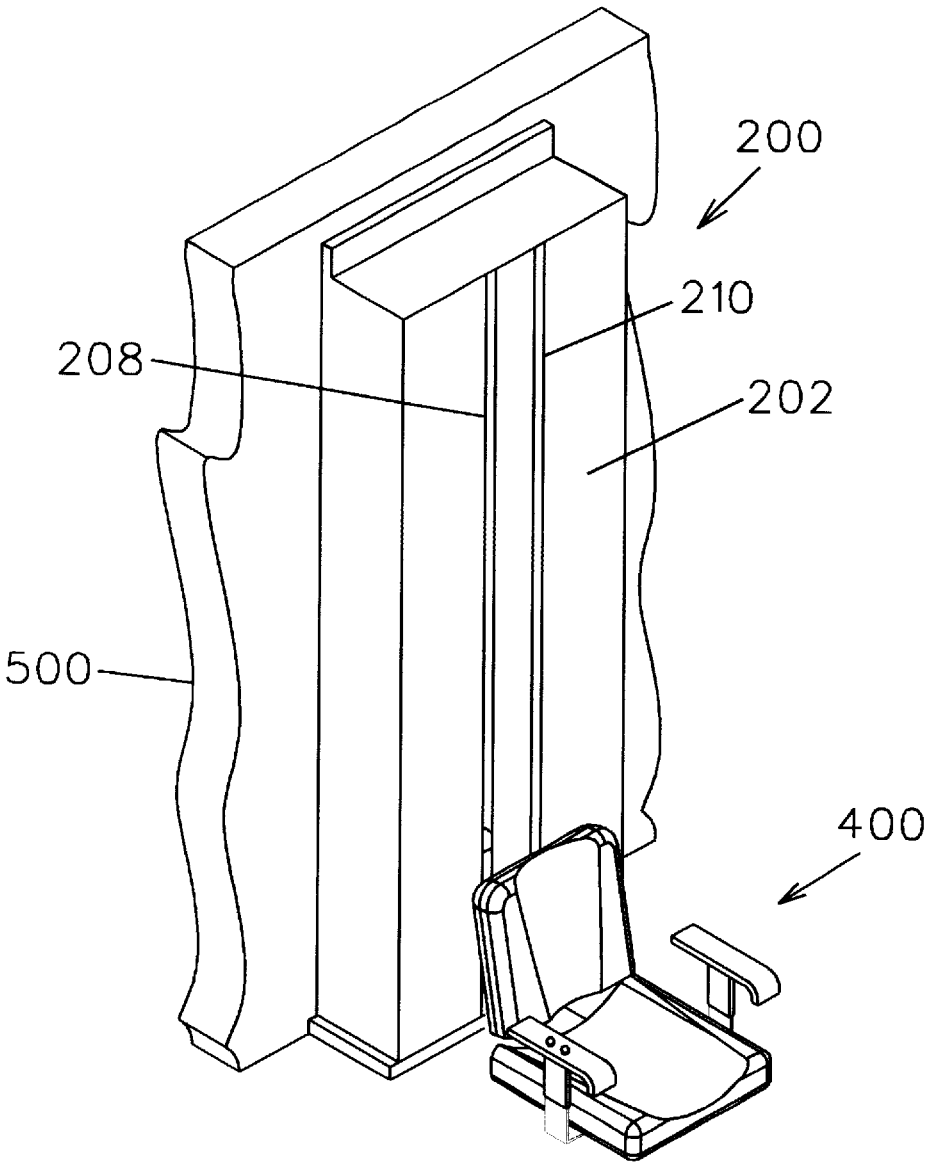
FIG. 9 is a perspective view of the apparatus of FIG. 8 showing the chair in a ground adjacent position.
Figure 10:
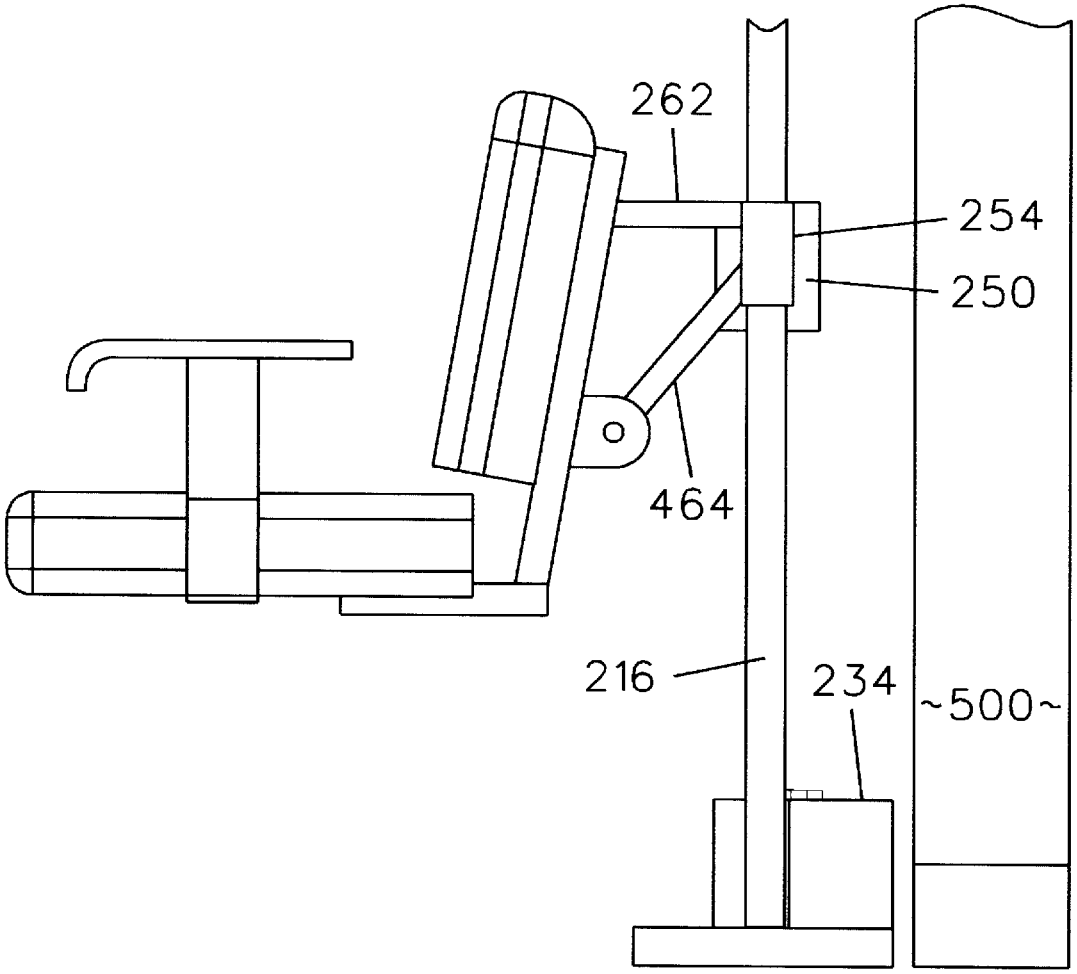
FIG. 10 diagrammatically illustrates a side view of the apparatus of FIG. 8.
Figure 11:
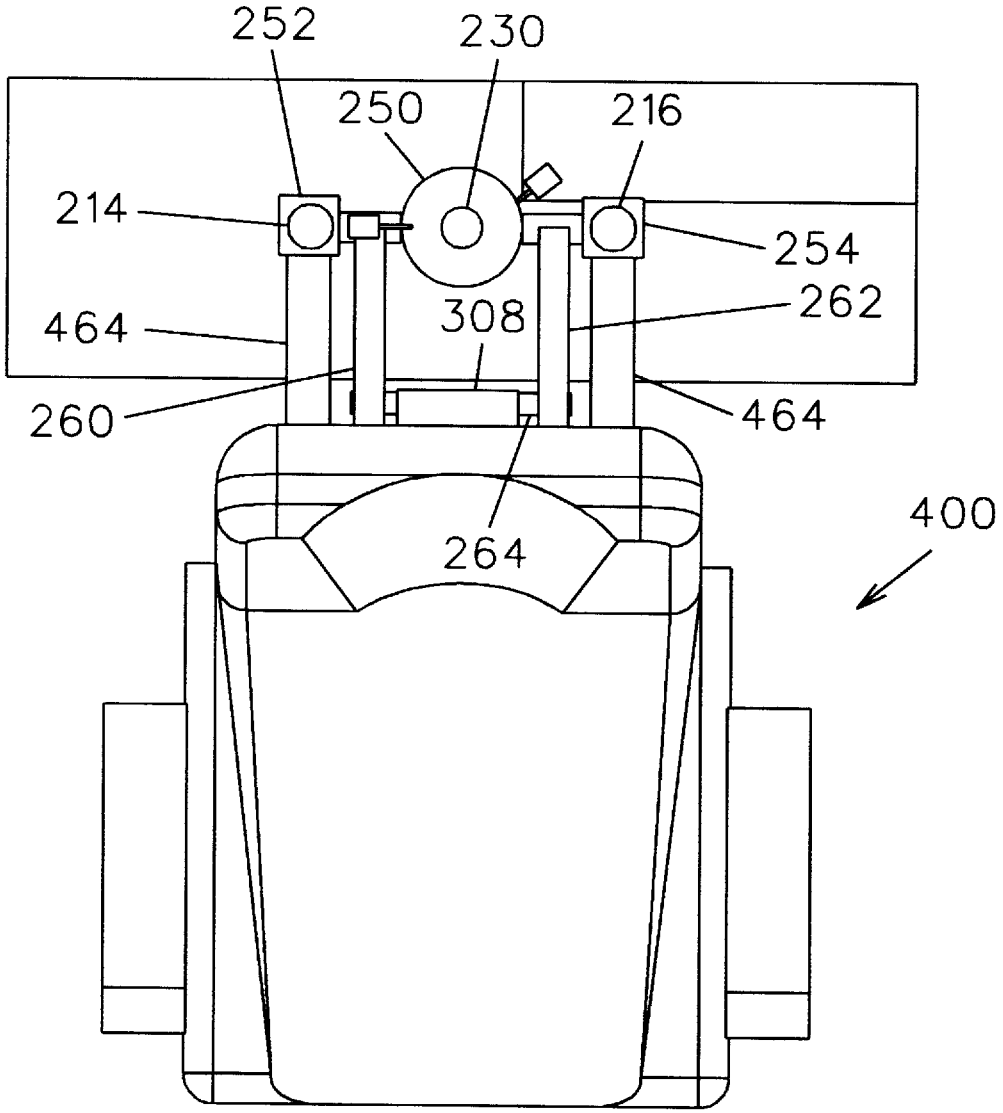
FIG. 11 is a top view of the patient lift of FIG. 10.

An alternate embodiment is as shown in FIG. 7 in which the bed 300 is replaced by a chair 400, the back of the chair being attached to the support arms of the hub 250. Strut 464 may also be added to stabilize the chair. Accordingly, movement of the hub 250 up or down the shaft 252 by depression of button 260' or 280' likewise moves a person seated in chair 400. This action enables the seated person to be more easily moved to a better position for subsequent standing or movement to another chair, such as a wheelchair 600 or the like.

It is to be understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A patient lift comprising:

a support frame adapted for attachment to a vertical surface;

a rotatable screw shaft mounted to said frame;

a hub means engaging said shaft for movement in one direction along said shaft upon a first rotation of said shaft in a first direction and movement in an opposed second direction upon rotation of said shaft in an opposed second direction;

chair means for supporting a patient thereon;

means for connecting said chair support means to said hub means;

means for rotating said shaft in said first and second opposed directions with said hub means and chair support means connected thereto traveling either up or down said shaft according to said direction of shaft rotation, said chair support means travel moving a patient seated thereon.

2. The patient lift as claimed in claim 1 wherein said rotating means comprises:

an electrically powered drive means;

means for coupling said drive means to said shaft;

control means for activating said drive means to rotate said shaft in either said first or second directions of rotation.

3. The patient lift as claimed in claim 1 wherein said support frame comprises:

at least one guide post adjacent said screw shaft;

a journal slidable along said at least one guide post and connected to said hub means for movement therewith, said journal maintaining said hub means in said engagement with said screw shaft.

4. The patient lift as claimed in claim 1 wherein said connecting means comprises at least one support arm extending from said hub means, said at least one support arm having said connecting means at an end thereof.

5. The patient lift as claimed in claim 4 wherein said connecting means at said at least one arm end comprises a shaft traversing said at least one support arm end, said shaft engaging said chair support means.

6. The patient lift as claimed in claim 5 further comprising a flange on a back of said chair support means, said flange engaging said shaft traversing said at least one support arm end.

7. The patient lift as claimed in claim 1 further comprising at least one strut extending between said hub means and said chair support means whereby to stabilize said chair support means.

8. A patient lift comprising:

a support frame adapted for attachment to a vertical surface;

a rotatable shaft vertically mounted to said frame;

a hoist engaging said shaft;

means for selectably moving said hoist in up and down directions along said shaft;

chair means for supporting a patient thereon;

means for connecting said chair support means to said hoist, said hoist and chair support means connected thereto travelling either up or down said shaft upon clockwise or counterclockwise directions of shaft rotation, said chair support means travel moving a patient thereon.

9. The patient lift as claimed in claim 8 wherein said moving means comprises:

means for mounting said shaft in said rotatable movement to said frame about a longitudinal axis of said shaft;

means for linking rotation of said shaft to said hoist;

means for a user-controlled rotation of said shaft.

10. The patient lift as claimed in claim 9 wherein said linking means comprises:

a first gear on said shaft;

a complementary gear on said hoist and engaging said first gear on said shaft, whereby a rotation of said shaft causes engagement of said first and complementary gears, whereby to move said hoist up or down said shaft.

11. The patient lift as claimed in claim 10 further comprising means for maintaining said first gear in said engagement with said complementary gear.

12. The patient lift as claimed in claim 11 wherein said maintaining means comprises:

at least one guide post adjacent said shaft;

a journal slidable along said guide post and connected to said hoist for movement therewith.

13. The patient lift as claimed in claim 8 wherein said connecting means comprises:

at least one arm extending from said hoist, said at least one arm having a first end connected to said hoist for movement therewith and a second end displaced from said hoist;

means at said second end of said at least one arm end for coupling with said chair means;

a flange on said chair means for engaging said coupling means.

14. The patient lift as claimed in claim 8 further comprising at least one strut extending between said chair means and said hoist whereby to stabilize said chair means.

15. A patient lift comprising:

a support frame adapted for attachment to a vertical surface;

a rotatable shaft mounted to said frame;

a hub engaging said shaft for movement in one direction along said shaft upon a first rotation of said shaft in a first direction and movement in an opposed second direction upon rotation of said shaft in an opposed second direction;

a chair for supporting a patient thereon;

means for connecting said chair to said hub;

means for rotating shaft in said first and second opposed directions with said hub traveling either up or down said shaft according to said direction of shaft rotation, said hub travel moving said chair to positions on said shaft corresponding to up or down travel of said hub along said shaft.

16. The patient lift as claimed in claim 15 wherein said rotating means comprises:

an electrically powered drive train for engagement with said shaft;

means for user control of said drive train in first or second modes, said first mode rotating said shaft in said first direction and said second mode rotating said shaft in said second direction.

17. The patient lift as claimed in claim 15 wherein said connecting means comprises:

at least one arm extending from said hub, said at least one arm having a first end connected to said hub for movement therewith and a second end displaced from said hub;

means at said second end of said at least one arm end for coupling with said chair;

a flange on said chair for engaging said coupling means.

18. The patient lift as claimed in claim 17 wherein said coupling means comprises a shaft traversing said at least one arm end, said traversing shaft engaging said flange.

19. The patient lift as claimed in claim 15 further comprising at least one strut extending between said hub and said chair whereby to stabilize said chair.

* * * * *

UNITED STATES PATENT AND TRADEMARK OFFICE

CERTIFICATE OF CORRECTION

PATENT NO. : 5,875,501

DATED : March 2, 1999

INVENTOR(S) : Dan E. Jury

It is certified that error appears in the above-identified patent and that said Letters Patent is hereby corrected as shown below:

Column 6, line 2, after the word "rotating" insert --said--.

Signed and Sealed this

Sixth Day of July, 1999

*Attest:*

*Attesting Officer*

Q. TODD DICKINSON

*Acting Commissioner of Patents and Trademarks*